United States Patent [19]

Zellmer et al.

[11] 3,961,555

[45] June 8, 1976

[54] SAFETY MECHANISM FOR INTERVALOMETERS AND DISTRIBUTORS

[75] Inventors: Wayne G. Zellmer; Marvin E. McGowan, both of China Lake, Calif.

[73] Assignee: The United States of America as represented by the Secretary of the Navy, Washington, D.C.

[22] Filed: Jan. 13, 1975

[21] Appl. No.: 540,479

[52] U.S. Cl. ..... 89/1.812; 89/1.814; 102/76 R

[51] Int. Cl.[2] ..... F41F 3/04; F42C 15/06

[58] Field of Search ..... 89/1.812, 1.813, 1.814, 89/1.8, 1.5 D; 102/76 R, 81.6

[56] References Cited

UNITED STATES PATENTS

| | | | |
|---|---|---|---|
| 2,960,037 | 11/1960 | Raech et al. | 102/76 R |
| 2,973,691 | 3/1961 | Goldsmith | 89/1.814 X |
| 3,000,315 | 9/1961 | Anastasia et al. | 102/76 R X |
| 3,396,628 | 8/1968 | Nash | 89/1.814 |
| 3,425,353 | 2/1969 | Halling | 102/76 R |
| 3,700,971 | 10/1972 | Everest et al. | 89/1.814 X |
| 3,728,936 | 4/1973 | Norris | 89/1.812 |

*Primary Examiner*—David H. Brown

*Attorney, Agent, or Firm*—R. S. Sciascia; Roy Miller; Gerald F. Baker

[57] ABSTRACT

A safety device for blocking movement of an actuating element of a mechanism wherein movement of said element is mechanically prevented so long as the blocking means is in place. Cooperating surfaces on the blocking means and the element respectively prevent removal or implacement of the blocking means whenever the actuating element is biased in an operating direction.

5 Claims, 18 Drawing Figures

ROTARY TAB PRINCIPAL – RIGHT ANGLE

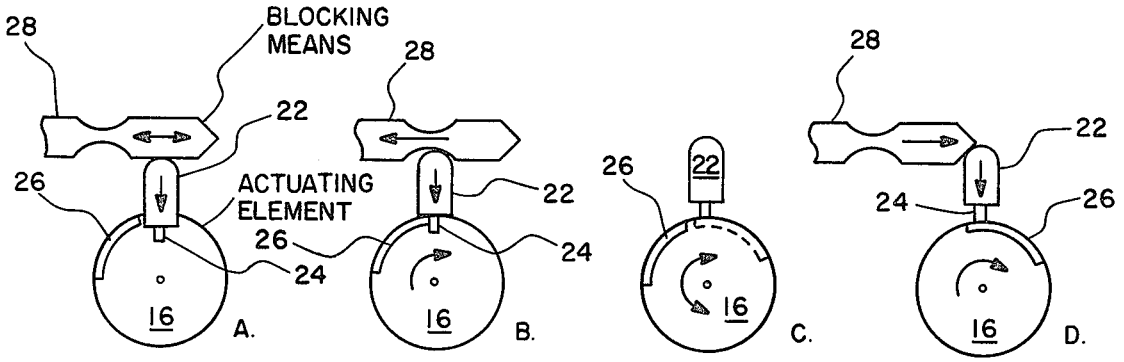
FIG. 3 ROTARY TAB PRINCIPAL – RIGHT ANGLE
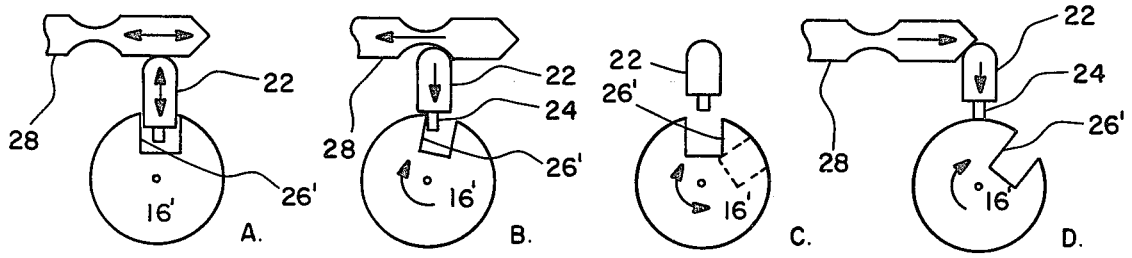
FIG. 4 ROTARY NOTCH PRINCIPAL – RIGHT ANGLE
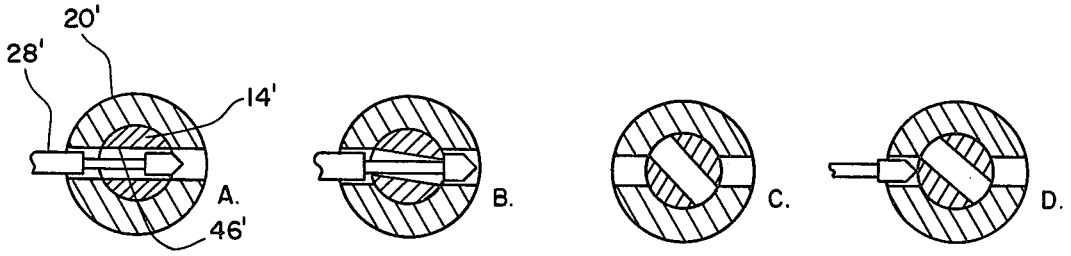
FIG. 5 ROTARY SHAFT PRINCIPAL – DIRECT
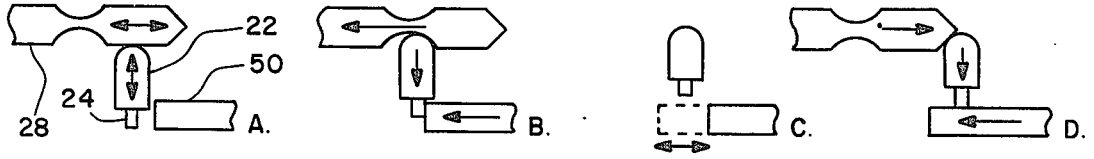
FIG. 6 LINEAR SLIDE PRINCIPAL – RIGHT ANGLE
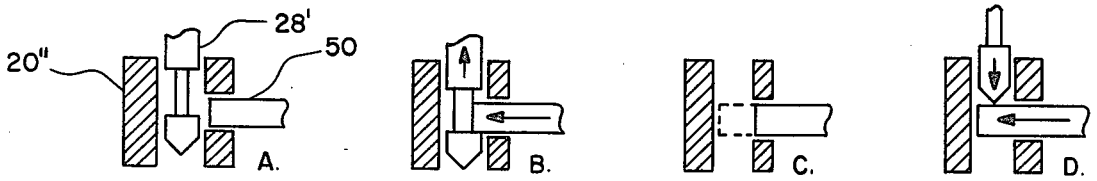
FIG. 7 LINEAR SLIDE PRINCIPAL – DIRECT

SAFETY MECHANISM FOR INTERVALOMETERS AND DISTRIBUTORS

BACKGROUND OF THE INVENTION

The present ordnance delivery systems use an electrical safety switch in series with the intervalometer. The function of the switch is to interrupt power flow to the intervalometer or distributor, and thus render the entire system inoperable. However, this switch has proven to be quite vulnerable to vibration breakage, loose wires, short circuits, and chattering during firing. In addition, if firing power is present, ordnance will be fired upon removal of the safety pin. Each of these shortcomings constitute a severe hazard to life and property.

SUMMARY OF THE INVENTION

According to the present invention, a sequential firing device such as an intervalometer or distributor is provided with a safety latch mechanism which may be selectively moved between a latching and unlatching position by means of a manually operable actuator. When the latching mechanism is in the latched position, however, should the firing device be energized, movement of the latch mechanism from the latching position is prevented.

BRIEF DESCRIPTION OF THE SEVERAL VIEWS OF THE DRAWING

FIG. 3 is a composite schematic view showing four positions (A, B, C and D) of the important operating parts of the FIG. 1 device;

FIGS. 4–7 are views similar to FIG. 3 depicting modifications of the FIG. 1 device;

DESCRIPTION AND OPERATION

Figure 1:
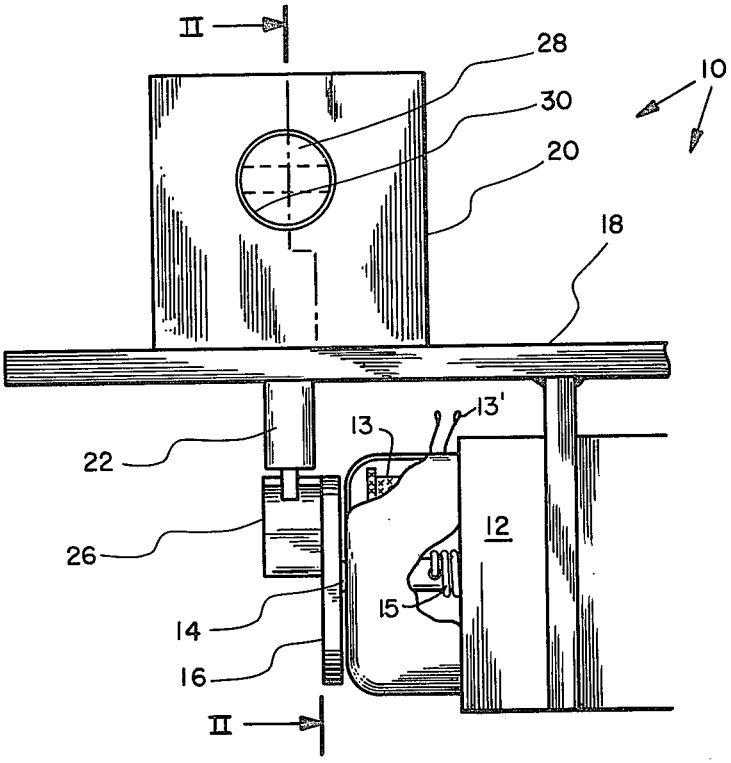
FIG. 1 is a side elevation showing a portion of a rocket launcher firing system according to the invention.
Figure 2:
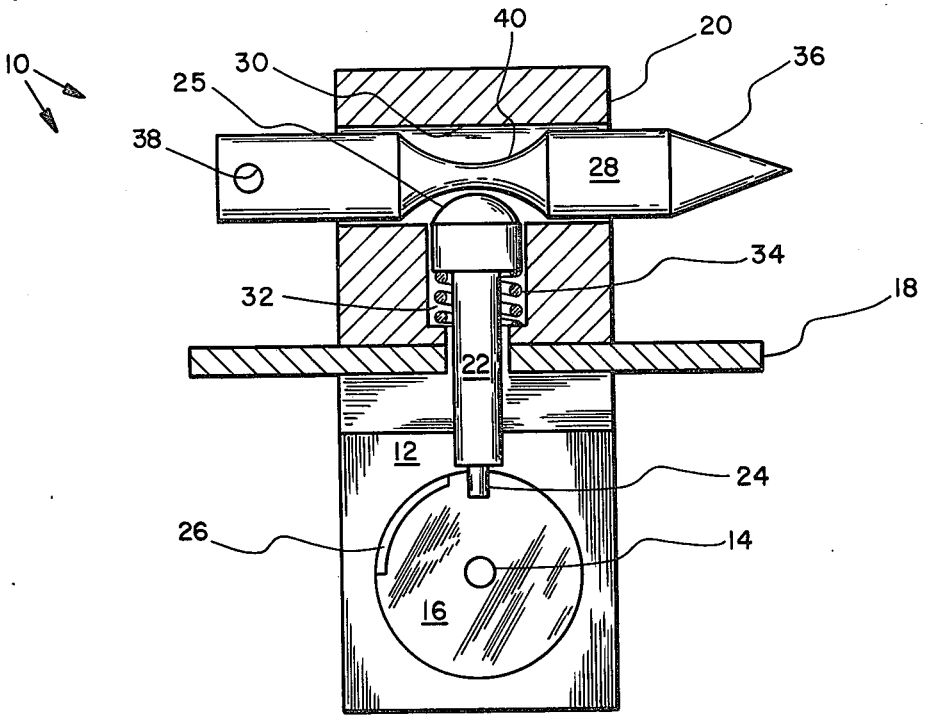
FIG. 2 is a cross-sectional view taken along line II—II of FIG. 1.

A preferred embodiment of the safety device according to the present invention as applied to a typical solenoid operated intervalometer indicated generally by the numeral 10 in FIGS. 1 and 2 of the drawing. The intervalometer 12 has a shaft 14 which extends therefrom to the left as viewed in FIG. 1 and, in this embodiment a disc 16 has been attached to the end of the shaft 14. The solenoid is actuated by applying current to coil 13 through conductors 13′ to rotate shaft 14 against the bias of spring 15 thus placing the mechanism in firing position. The intervalometer 12 is attached to framework 18 and a pin block 20 is attached to the same framework adjacent the disc 16. Block 20 carries an intermediate safety slide 22, the details of which are better shown in FIG. 2.

The pin 22 has a contoured end 24 designed to cooperate with a tab 26 on disc 16 as will be explained below. The opposite end of slide 22 is contoured to cooperate with a safety pin 28 situated orthogonal to slide 22 in a hole 30 provided therefor in block 20. Pin 22 is fitted for sliding action in a bore 32 in block 20 and is biased upwardly as viewed in FIG. 2 by a spring 34.

Pin 28 has a first end 36 tapered to cooperate with surface 25 to facilitate insertion of the pin 28 in hole 30 and the opposite end of pin 28 is drilled at 38 to accomodate an extraction ring (not shown). The central portion of pin 28 is contoured at 40 in such a manner that any movement from the central position as shown will result in downward movement of slide 22 for reasons which will become clear in the following explanation of the operation.

FIGS. 3–7 illustrate the various ways in which the objects of the invention may be achieved. In FIG. 3, for example, views A, B, C and D illustrate various positions of the components of the embodiment of FIGS. 1 and 2. FIG. 4 shows a similar device in which the disc 16 is modified as shown at 16′ by providing a notch 26′ in lieu of the tab 26. In the FIG. 5 embodiment a modified pin 28′ acts directly in a slot 46′ provided on the end of shaft 14′ and in FIGS. 6 and 7 the principals of the invention are applied to a reciprocating member 50.

Returning to the embodiment in FIG. 3, view A illustrates the downward travel of slide 22 when the pin 28 is inserted or removed. With the pin in place, slide 22 is always in a position wherein the surface 24 is in the path of tab 26 on disc 16. While in this position, should disc 16 be urged in the direction of the arrow in view B, as by application of power to the mechanism, pin 28 cannot be removed. This is so because the tab 26 is resting against the surface 24 of pin 22 and blocks its downward passage.

With the pin removed as illustrated in view C, the disc 16 is free to oscillate between its limits of travel as illustrated by the solid line and dotted line positions of tab 26. This is the ARMED condition of the system. Should an attempt be made to insert the arming pin 28 at a time when the system is energized, the situation illustrated in view D will prevail and insertion of pin 28 will be prevented. This is true because movement of disc 16 in the direction of the arrow in view D will cause tab 26 to be interposed into the path of slide 22 and the downward travel of slide 22 necessary for the insertion of pin 28 is blocked.

It will be apparent from a cursory examination of the views in FIG. 4 that the same principals of operation can be achieved by a modified disc 16′ having a slot 26′ therein cooperating with the surface 24 of slide 22.

In the FIG. 5 device the shaft of the intervalometer is modified as shown at 14′ to provide a slot 46′ which will cooperate with a modified pin 28′ to achieve the same results as with the embodiments of FIGS. 3 and 4.

Where the solenoid actuated member is reciprocating rather that rotary, the desired results may be achieved either by utilizing the pin 28 and slide 22 as illustrated in FIG. 6 or by using the modified pin 28' in a block 20'' modified to receive one end of the reciprocating member 50 as illustrated in FIG. 7.

Figure 8:
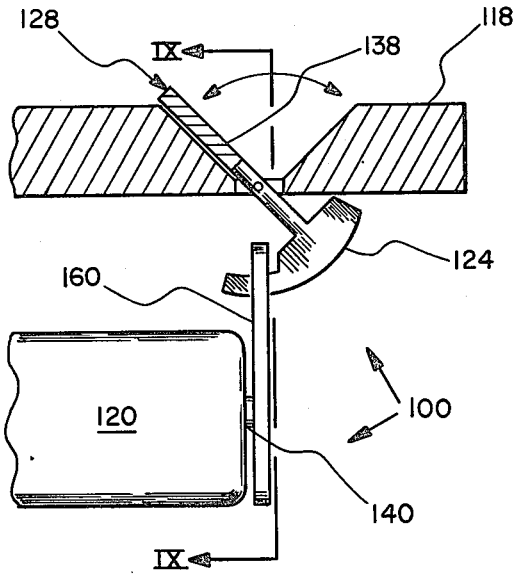
FIG. 8 is a side elevation of a further embodiment of the invention.
Figure 9:
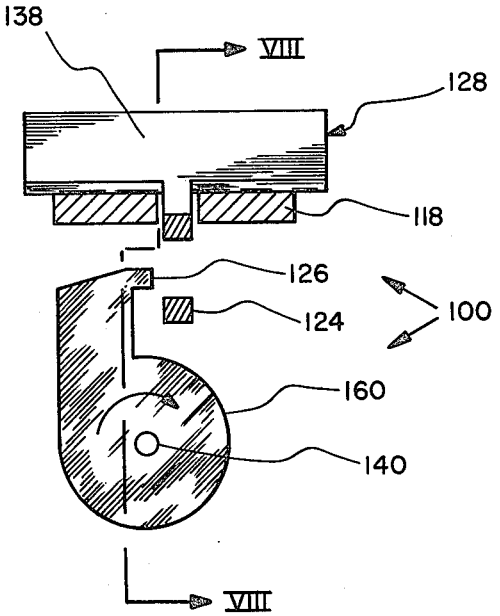
FIG. 9 is a view taken along line IX—IX of FIG. 8.

The modification shown in FIGS. 8 and 9 utilizes a toggle lever 128 having an end 124 contoured to cooperate with a modified tab 126 on the solenoid disc 160. The device is shown in the SAFE condition allowing only limited travel of the solenoid shaft 140 in a clockwise direction. A tab 138 is provided on lever 128 for manual positioning of the lever and when the lever is in the extreme opposite position from that shown, the contour of end 124 will allow full motion of shaft 140 in the clockwise direction.

Figure 10:
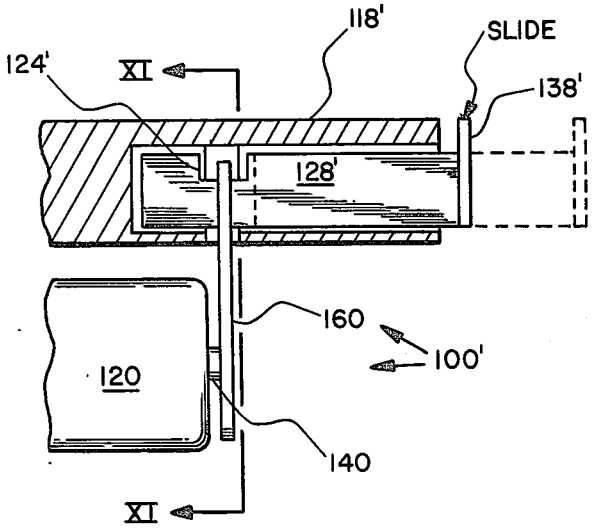
FIG. 10 is a side elevation of a variation of the FIG. 8 device.
Figure 11:
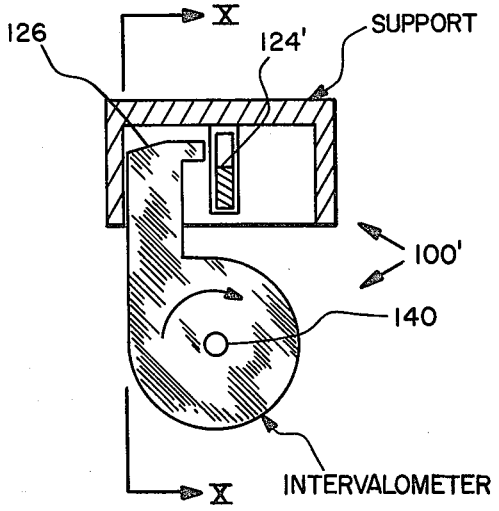
FIG. 11 is a cross-sectional view taken along line XI—XI of FIG. 10.

An embodiment similar to the FIG. 8 device using a sliding member 128' is shown in FIGS. 10 and 11.

Figure 12:
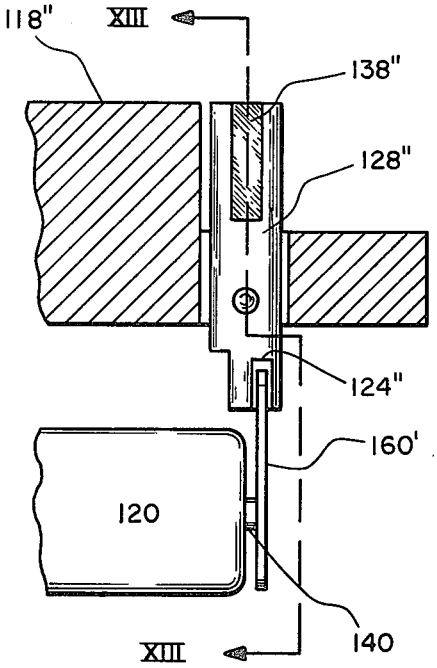
FIG. 12 is a side elevation of a still further embodiment of the invention.
Figure 13:
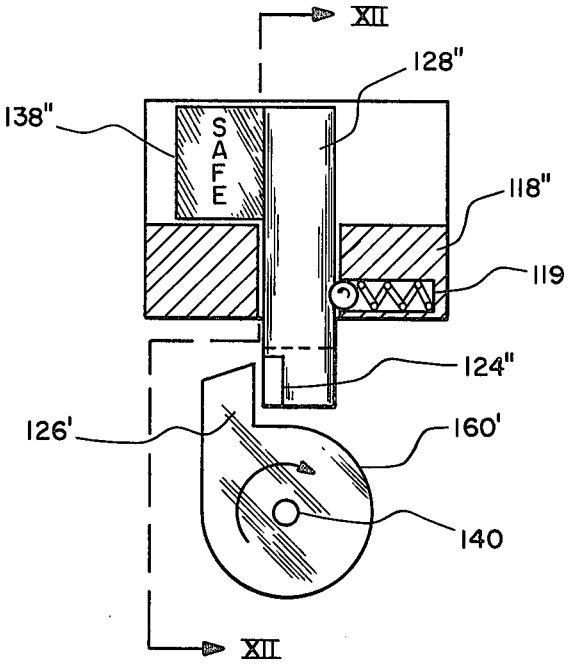
FIG. 13 is a cross-sectional view taken along line XIII—XIII of FIG. 12.

FIGS. 12–15 illustrate two embodiments of what might be termed the turn button type. In FIG. 12, for example, a rotary member 128'' has an end 124'' contoured to cooperate with the solenoid disc 160' and the rotary member 128'' is designed to be rotated by a tab 138''. In the FIG. 14 device the modified rotary member 128''' has an end 124''' cooperating with the solenoid disc 160' and with the added feature that the shaft 128''' will rotate through 360 degrees. Shaft 128''' is actuated by a four lobed end 138''', the lobes of which are alternately labeled SAFE or ARM. In this embodment, the orientation of shaft 128''' may be at any one of four detent positions 90° apart. In these positions the device is alternately in SAFE and ARM condition.

Figure 16:
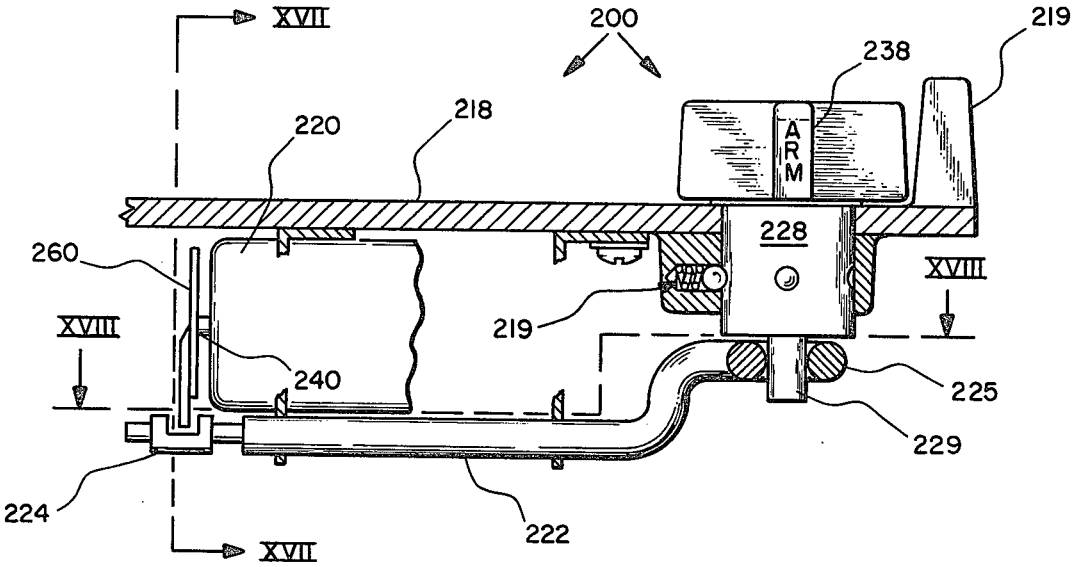
FIG. 16 is a side elevation partly in section of a variation of the device of FIG. 14.

A still further embodiment of the invention wherein the actuator is at the opposite end is generally indicated by the numeral 200 in FIG. 16. In this device, as in the FIG. 14 device a rotary actuator is used. The rotary actuator 228 carries an eccentric pin 229 which cooperates with a slotted end 225 of a slide 222. Slide 222 has an end 224 contoured to cooperate with the solenoid disc 260 in a manner similar to the above embodiments.

Figure 14:
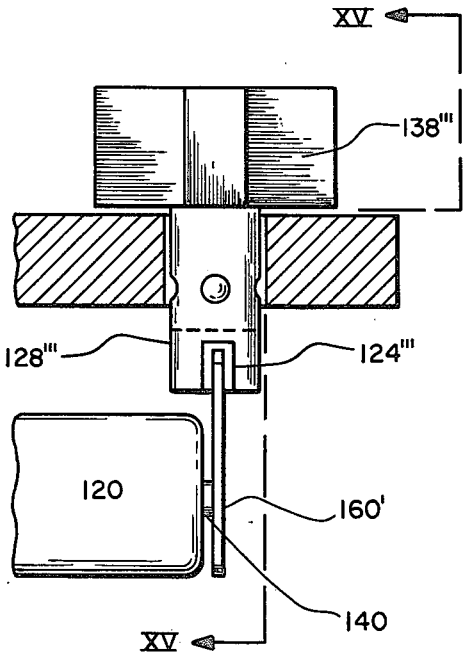
FIG. 14 is a side elevation of a variation of the FIG. 12 device.
Figure 15:
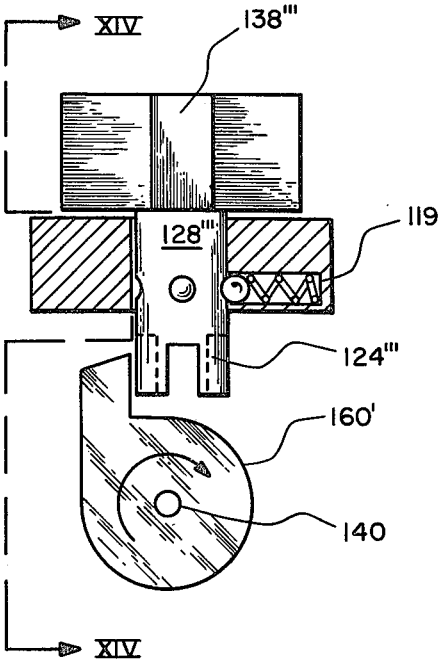
FIG. 15 is a cross-sectional view taken along line XV—XV of FIG. 14.
Figure 17:
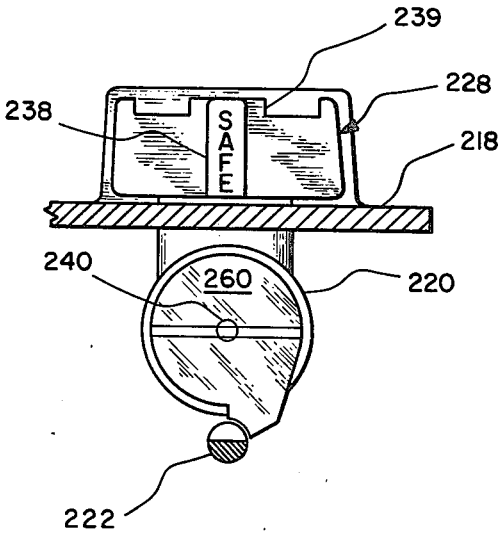
FIG. 17 is a cross-sectional view taken along line XVII—XVII of FIG. 16.

The rotary member 228 is surmounted by a cross lever 238 similar to that shown in FIG. 14 and two opposing projections of the lever are shown relieved at 239 to provide a tactile indication of lever position. If desired, two sides of the lever 238 may be hidden from view by abutments 219 integral with the support member 218. The device in the position shown in FIG. 16, therefore, may be viewed from either side to show an ARM condition. The other two lobes of lever 238 are marked SAFE as shown in FIG. 17 and will be presented to view only by rotation of number 228 90°.

Figure 18:
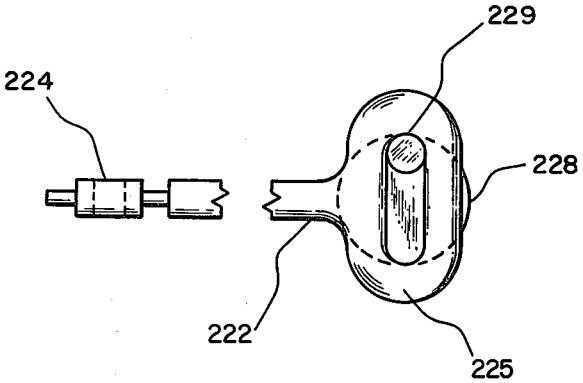
FIG. 18 is a plan view of an element of FIG. 16.

FIG. 18 shows the pin and slot arrangement of the cooperating surfaces of actuator 228 and slide 222.

From the foregoing it will be appreciated that Applicants have provided a SAFE and ARM device for rocket firing (FIRE) systems which will permit rotation of the device to a firing position when desired but will prevent moving of the device or any indicators to a safe reading while current is present on the firing solenoid.

What is claimed is:

1. In a firing device for ordnance or the like the combination comprising:

an electrically operable actuating element movable between a normal SAFE position and a FIRE position for firing said ordnance;

energy storage means biasing said element to said SAFE position;

energy output means effectively connected to said element for moving said element to said FIRE position;

blocking means associated with said element and relatively movable from a position disabling full movement of said element to a position enabling full movement of said element;

said blocking means and said element including complementary cooperating surfaces which coact to prevent movement of said element to said FIRE position when said blocking means is in said disabling position and to allow movement of said element to said FIRE position when said blocking means is in said enabling position; and said surfaces further cooperating to prevent movement of said blocking means from either position to the other when said energy output means is acting to urge said element from said SAFE position to said FIRE position.

2. The device of claim 1 wherein said blocking means include at least one reciprocable sliding member and one of said cooperating surfaces of said blocking means is a feature of said sliding member.

3. The device of claim 2 wherein said blocking means includes a primary sliding member and a secondary orthogonal sliding member; one of said cooperating surfaces being a feature of said secondary member; and said primary member being arranged to transfer motion to said secondary member.

4. The device of claim 1 wherein said blocking means further includes a primary sliding member and a secondary orthogonal sliding member;

one of said cooperating surfaces being a feature of said secondary member being arranged to normally block full movement of said secondary member and to transfer motion to said secondary member when moved in either of two directions from a central position.

5. The device of claim 4 wherein said primary sliding member includes surfaces cooperating with said secondary member and wherein said primary member must be removed from the system before said secondary member is enabled to move sufficiently to enable said element to move to said FIRE position;

said complentary cooperating surfaces coacting, when said energy outputs means is acting, to prevent insertion or removal of said primary member.

* * * * *